US008046889B2

(12) United States Patent
Tilley

(10) Patent No.: US 8,046,889 B2
(45) Date of Patent: Nov. 1, 2011

(54) UNIVERSAL INSTALLATION TOOL FOR BEARINGS

(76) Inventor: Michael J Tilley, Phoenix, AZ (US)

( * ) Notice: Subject to any disclaimer, the term of this patent is extended or adjusted under 35 U.S.C. 154(b) by 360 days.

(21) Appl. No.: 11/821,724

(22) Filed: Jun. 25, 2007

(65) Prior Publication Data

US 2008/0313889 A1 Dec. 25, 2008

(51) Int. Cl.
*B25B 27/14* (2006.01)

(52) U.S. Cl. ..... 29/275; 29/282; 29/278

(58) Field of Classification Search ..... 29/275, 29/282, 283, 280, 251, 278
See application file for complete search history.

(56) References Cited

U.S. PATENT DOCUMENTS

| | | | | | |
|---|---|---|---|---|---|
| 1,897,737 | A | | 2/1933 | Snarr | |
| 2,284,522 | A | | 5/1942 | Keen | |
| 2,775,025 | A | | 12/1956 | Williams | |
| 2,861,330 | A | | 11/1958 | Kratz | |
| 3,083,449 | A | * | 4/1963 | Simmons | 29/255 |
| 3,942,234 | A | * | 3/1976 | Kepler | 29/724 |
| 4,303,233 | A | * | 12/1981 | Meyer, III | 269/54.5 |
| 4,339,865 | A | | 7/1982 | Shultz | |
| 4,429,447 | A | | 2/1984 | Davis | |
| 4,586,228 | A | * | 5/1986 | Rodolf | 29/235 |
| 5,528,809 | A | | 6/1996 | Green | |
| 5,727,298 | A | * | 3/1998 | Strong | 29/259 |
| 5,894,665 | A | | 4/1999 | Olmsted | |
| D440,837 | S | | 4/2001 | Hart | |
| 6,442,817 | B1 | | 9/2002 | Swanson | |
| 6,601,277 | B1 | * | 8/2003 | Swanson | 29/256 |
| 6,886,230 | B2 | | 5/2005 | Dagot | |
| 2008/0313889 | A1 | * | 12/2008 | Tilley | 29/724 |

* cited by examiner

*Primary Examiner* — Lee D Wilson
(74) *Attorney, Agent, or Firm* — Weiss & Moy, P.C.; Jeffrey D. Moy

(57) ABSTRACT

A universal tool for installing annular parts, components, or devices such as tapered and non-tapered bearings on shafts includes a cap, a tube, and cooperating interchangeable force distributors. A first interchangeable tapered force distributor attaches to the tube and includes a tapered or beveled edge allowing for proper visual alignment with, and isolated force distribution on, the inner race of a tapered bearing. A second interchangeable non-tapered force distributor also attaches to the tube and includes an annular flange with a substantially flat surface that cooperates with the inner and outer races of the ball bearing such that force applied to the cap of the universal tool is evenly distributed around the inner and outer races of the ball bearing. A connector piece can be used to connect two tubes in order to accommodate longer shafts. For a press-through design, a modified cap comprising an external non-tapered force distributor can be substituted when a machine press is used to install the bearing on the shaft. The non-tapered force distributor allows the shaft to extend therethrough and supports the universal tool when it is inverted and secured to the machine press.

2 Claims, 8 Drawing Sheets

UNIVERSAL INSTALLATION TOOL FOR BEARINGS

FIELD OF INVENTION

This invention relates to an installation tool for installing different sizes and types of bearings. In particular, this invention relates to a universal tool for applying bearings using either manual force or machine force with, for example, a hydraulic press. Additionally, this invention particularly relates to a tool capable of installing both tapered bearings and non-tapered bearings around shafts of various sizes.

BACKGROUND

Bearing assemblies, such as roller or ball bearings, are typically placed between a fixed member and a rotating member. For example, a roller bearing is placed between a shaft that rotates and a housing that remains stationary. The bearing must be securely and properly fitted either to the fixed or rotating member. The clearance between the bearing and the shaft when the bearing is properly positioned is referred to as a press fit or interference fit, as is known in the art.

One common use for ball bearings and tapered bearings is automobile transmissions. Bearings used in automobile transmissions must achieve a press-fit around the distal end of a long shaft. Because the clearance between the bearing and shaft is minimal, the bearing does not easily slide onto the shaft and must be forcibly positioned.

The conventional way of installing the bearings on a transmission shaft involves first placing the bearing on the proximate end of the shaft and gently tapping, for example with a roll punch and a hammer, the bearing into place. Generally, the roll punch is positioned at a point on the outer race of the bearing and the hammer strikes the base of the roll punch. Because tapping exerts pressure only on one point of the bearing, however, the bearing tends to slide along the shaft only at that point. The bearing must therefore be tapped on other perimeter points of the outer race to coax the bearing into place. Accordingly, repeatedly tapping around the perimeter is necessary until the bearing is seated correctly in its position. Unfortunately, this process can lead to witness marks, chips, or cracks around the race of the bearing wherever the bearing was tapped, which would prevent one or more of the balls or rollers from rolling smoothly. Further, when a shaft is contained within a large housing, it can be difficult to squeeze the punch tool and hammer into the housing to position the bearing.

Alternative methods of coaxing a bearing into place have been tried, but each method requires numerous tools specific to the shaft or bearing being installed, which is cumbersome to store. It would be desirable therefore to have a universal bearing installer capable of seating different types and sizes of bearings around different sizes of shafts. It would be particularly desirable to have a universal tool capable of installing both non-tapered and tapered bearings.

One object of the present invention is to provide a universal tool capable of installing both tapered bearings and non-tapered bearings by changing minimal tool components and without requiring duplicate cumbersome components for each type or size of bearing. Another object is to provide a universal tool capable of adapting to be used with unusually long shafts. Yet another object is to provide a universal tool capable of adapting for use with a machine press, such as a hydraulic press or pneumatic press.

SUMMARY OF THE INVENTION

A universal tool for installing annular members, such as tapered and non-tapered bearings, on shafts includes a cap, a tube, and cooperating interchangeable force distributors. The force distributors are specific to the annular members or bearings that they install.

A tapered force distributor attaches to the tube for use with a tapered roller bearing. The tapered force distributor includes a sleeve that attaches to the tube with frictional O-rings or threads and thread grooves. It also includes an annular flange that abuts the distal end of the tube. An annular tapered or beveled section extends from the flange and connects to an annular contact region. The contact region cooperates with the inner race of the tapered bearing to cause force applied to the cap of the universal tool to be evenly distributed only on the inner race of the tapered roller bearing.

A second force distributor attaches to the tube for use with non-tapered bearings, such as a ball bearing. The non-tapered force distributor also includes a sleeve that attaches to the tube with O-rings or threads and thread grooves. It also includes an annular flange that abuts the distal end of the tube. The flange has a substantially flat surface that cooperates with the inner and outer races of the ball bearing such that force applied to the cap of the universal tool is transferred through the tube and evenly distributed around the inner and outer races of the ball bearing at the same time.

For shafts that are long, multiple tubes can be connected together with an annular connector. Multiple tubes and multiple connectors can be linked together to accommodate any length shaft. Alternatively, long shafts can be accommodated by a press-through design. For the press-through design, a modified cap comprises a non-tapered force distributor. This allows the universal tool to be inverted and situated on a machine press, such as a hydraulic press or pneumatic press.

DETAILED DESCRIPTION OF THE INVENTION

Figure 1A:
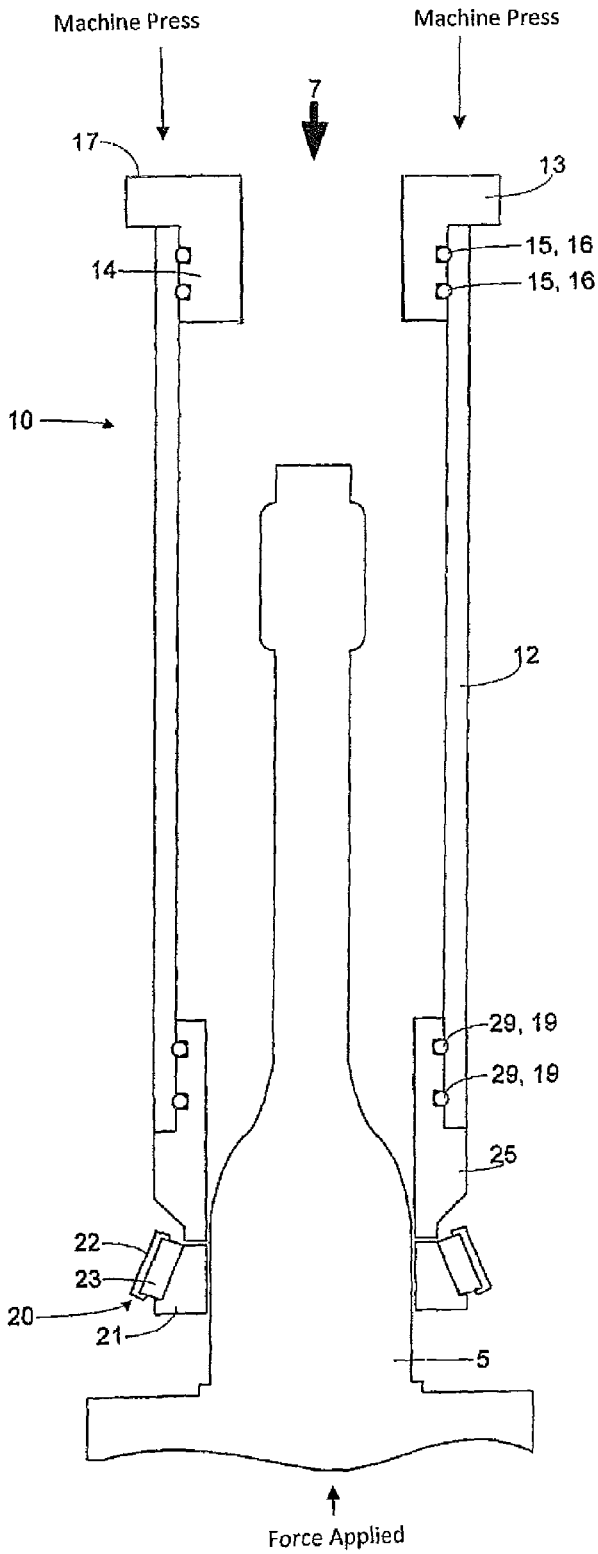
FIG. 1*a* is a cross-sectional view of the first embodiment of the present invention.

In order to properly position a variety of sizes of annular parts, such as tapered and non-tapered bearings, on a variety of sizes of shafts a universal tool is needed. FIG. 1 generally illustrates the basic components of a universal tool 10 for installing both tapered and non-tapered bearings. Universal tool 10 comprises a cap 13, a hollow tube 12, and a force distributor 25. In use, tube 12 has a proximal end and a distal end, with force distributor 25 being removeably attached to the distal end of tube 12 and cap 13 being removeably attached to the proximal end of tube 12. A bearing 20 is loosely placed on a shaft 5 waiting installation. Shaft 5 can be any type of shaft, including a transmission shaft. Bearing 20 can be any type of bearing, but the type of force distributor selected must coordinate with the type of bearing being installed. For example, FIG. 1 shows a tapered roller bearing 20 and a tapered force distributor 25. Force distributor 25 is interchangeable with other force distributors.

Universal installation tool 10 is placed over shaft 5 such that force distributor 25 is aligned with bearing 20. A force, represented by arrow 7, is to be applied by some instrument, such as a hammer, to cap 13. This force is transferred through tube 12 to force distributor 25. The force is thereupon transmitted to bearing 20, causing bearing 20 to uniformly move along shaft 5. A continuous force of varying measure can be applied until the bearing is securely and properly positioned, or repeated staccato applications of force can be used until the bearing is seated as desired.

If the shaft is particularly long, more than one tube can be connected together to create a longer tube, which will be described in detail later with reference to FIGS. 5*a*-5*c*. Alternatively, if a continuous force is to be applied with a machine press, cap 13 can be replaced with a modified cap comprising a non-tapered force distributor, which will be described later with reference to FIG. 6. Finally, many types of bearings can be installed by simply changing the force distributor to coordinate with the bearing being installed, which will be illustrated in FIGS. 2*a* through 3*f*.

As shown in FIG. 1*a*, cap 13 comprises a top 17 and a stem 14 and removeably and frictionally attaches to tube 12 preferably with one or more o-rings 16 positioned in one or more annular grooves 15. Top 17 of cap 13 constitutes a generous surface for applying force with, for example, a hammer. In the preferred embodiment, the diameter of top 17 is slightly larger than the outer diameter of tube 12. Thus, when a user holds tube 12, his hand is protected from the instrument applying force to cap 13. The diameter alternatively can be the same as the outer diameter of tube 12. Stem 14 is preferably integrally formed with top 17; however, any method of attaching two objects can be used, as is known in the art. The diameter of stem 14 is slightly smaller than the inner diameter of tube 12. This enables cap 13 to securely, yet removeably, be inserted in the proximal end of tube 12 when in use. While O-rings preferably frictionally secure stem 14 of cap 13 within tube 12, any method of removeably attaching two cylinders can be used. For example, cap 13 and tube 12 can be connected with threads and thread grooves.

Figure 1B:
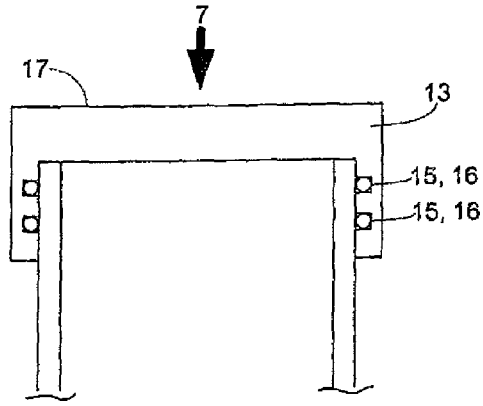
FIG. 1*b* is a cross-sectional view of an alternative embodiment of the cap of the first embodiment of the present invention.

An alternative embodiment of cap 13 is shown in FIG. 1*b*. Stem 14 can be hollow and larger than tube 12 so that the proximal end of tube 12 is inserted in stem 14. Again, tube 12 can be frictionally secured in stem 14 with one or more O-rings or threads and thread grooves, or any other manner of removeably attaching two cylinders, as is known in the art. An externally mounted cap will also protect a user's hands.

In the preferred embodiment, the diameter of stem 14 is 1⅝ inches, and stem 14 is ¾ inches in height. Also, preferably two O-rings are used to frictionally secure stem 14 when it is inserted in tube 12. Top 17 is 1 15/16 inches in diameter and 7/16 inches in height. Cap 13 also is preferably comprised of steel. Alternatively, cap 13 can be comprised of any rigid material softer than the race of the bearing being installed.

Tube 12 has an inner diameter and an outer diameter, with the difference between the inner and outer diameters comprising the tube's wall thickness. The inner diameter must be large enough to be positioned around a shaft. In the preferred embodiment, it is large enough to be positioned around most automobile transmission shafts. The outer diameter, however, preferably is not too large that it cannot be positioned around an automobile transmission shaft while the shaft remains attached to the automobile transmission. In the preferred embodiment, the outer diameter of tube 12 is approximately 2 inches, the inner diameter is approximately 1⅝ inches, and the wall thickness is approximately 3/16 inches. Additionally, tube 12 is preferably 9 inches in height. Tube 12 also is preferably comprised of steel. Alternatively, tube 12 can be comprised of any rigid material softer than the race of the bearing being installed.

Figure 2A:
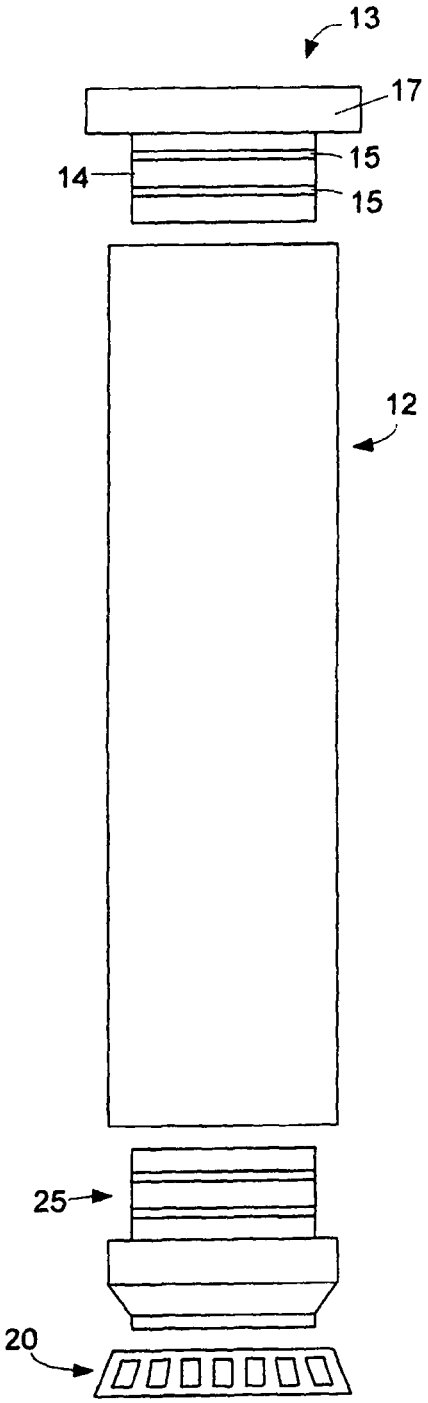
FIG. 2*a* illustrates the components of the first embodiment of the present invention.
Figure 2B:
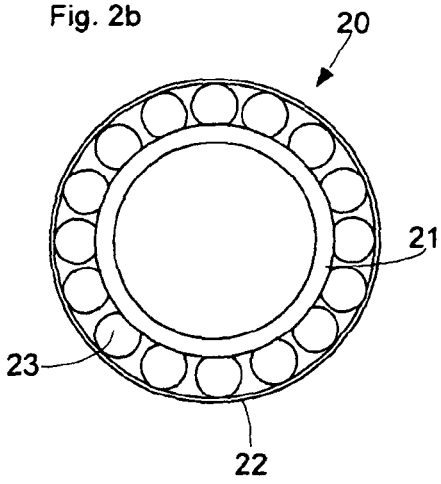
FIG. 2*b* is a top view of a tapered roller bearing as used with the first embodiment of the present invention.
Figure 2C:
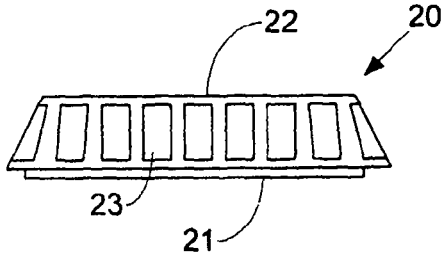
FIG. 2*c* is a side view of a tapered roller bearing as used with the first embodiment of the present invention.
Figure 2D:
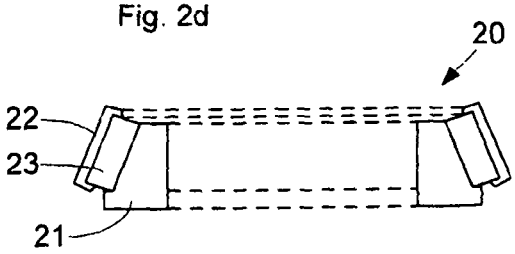
FIG. 2*d* is a cross-sectional view of a tapered roller bearing as used with the first embodiment of the present invention.
Figure 2E:
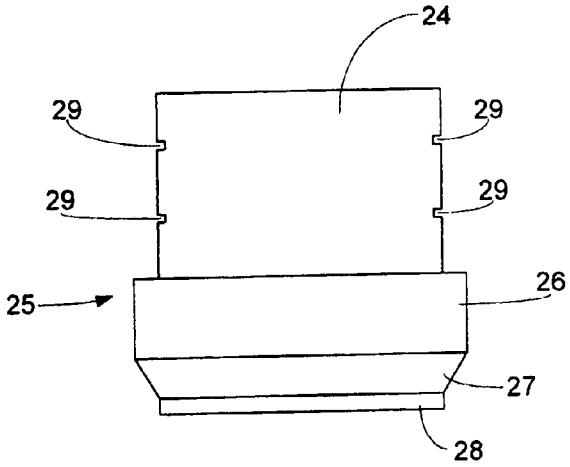
FIG. 2*e* is a cross-sectional view of the force distributor of the first embodiment of the present invention.
Figure 2F:
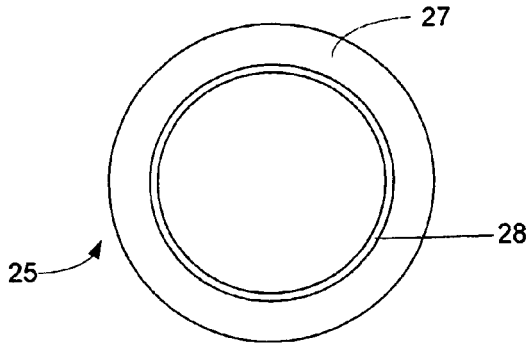
FIG. 2*f* is a bottom view of the force distributor of the first embodiment of the present invention.
Figure 2G:
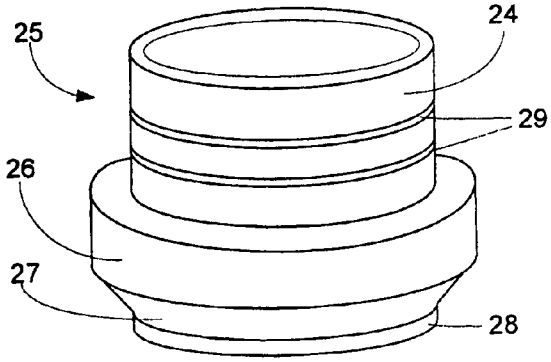
FIG. 2*g* is a perspective view of the force distributor of the first embodiment of the present invention.

The force distributor in the first and the preferred embodiment of universal installation tool 10 is a tapered force distributor 25, which can be used to install a tapered bearing such as a tapered roller bearing 20. FIGS. 1*a* and 2*a* illustrate tapered force distributor 25 in use with tapered roller bearing 20. FIGS. 2*b*-2*d* illustrate tapered roller bearing 20 in detail, and FIGS. 2*e*-2*g* illustrate tapered force distributor 25 in detail. In general, and as shown in FIGS. 2*b*-2*d*, a tapered roller bearing has an inner conical race 21, a cage 22 and rollers 23. When properly positioning a tapered roller bearing on a shaft, it is particularly desirable to apply force only to inner conical race 21. By doing so, cage 22 and rollers 23 are not damaged, and the operational integrity of tapered roller bearing 20 is preserved. Accordingly, tapered force distributor 25 is designed so that it only applies force to the inner conical race 21 and so that a user can visually determine that the force distributor 25 is properly aligned with the inner race of the tapered bearing.

As shown in the figures, tapered force distributor 25 is generally tubular in shape. Tapered force distributor 25 includes a sleeve 24 integrally connected with an annular flange 26. The flange integrally connects with an annular tapered or beveled section 27, which integrally connects with an annular contact region 28. Contact region 28 abuts the inner conical race 21 of tapered bearing 20 when universal tool 10 is in use such that force is evenly distributed around inner conical race 21.

In the preferred embodiment, tapered force distributor 25 contacts the inner race of the tapered bearing near the center of the inner race. Force distributor accordingly has an inner diameter large enough to be positioned over shaft 5 and preferably slightly larger than the inner diameter of the inner race of the bearing to be installed. In this preferred embodiment, the inner diameter of force distributor 25 is approximately 1½ inches for all of its sections.

The outer diameter of force distributor 25 at the sleeve 24 is slightly narrower than the inner diameter of tube 12. In the preferred embodiment, the outer diameter of the flange is the same as the outer diameter of tube 12. Alternatively, the diameter of flange 26 can be larger that the diameter of tube 12. Contact region 28 has an outer diameter smaller than flange 26. Preferably, the outer diameter of contact region 28 is slightly smaller than the outer diameter of the inner race of the tapered bearing to be installed. Beveled section 27 gradually decreases in outer diameter as it connects flange 26 and contact region 28, as shown in FIGS. 2*e*-2*g*. In the preferred embodiment, the outer diameter of sleeve 24 is approximately 1⅝ inches, of flange 26 is approximately 2 inches, and of contact region 28 is approximately 1 11/16 inches.

The height of the various parts of force distributor 25 can vary depending on the bearing to be installed, as is known in the art. In the preferred embodiment, the height of sleeve 24 is approximately ¾ inches, of flange 26 is approximately ⅜ inches, of beveled section 27 is approximately ¼ inches, and of contact region 28 is approximate ⅛ inches. Any height that allows for adequate placement or alignment of the contact region on the inner race of the tapered bearing to be installed is acceptable. Additionally, for some applications contact region 28 can be of negligible height or just the bottom edge or surface of beveled section 27.

In the preferred embodiment, around the outer surface of the sleeve 24 of force distributor 25 there are two annular grooves 29 for holding rubber O-rings 19. Sleeve 24 can be inserted in tube 12 such that the distal end of tube 12 abuts flange 26, and the O-rings ensure a snug and secure frictional fit yet still allow force distributor 25 to be detached and interchanged for other force distributors. Alternatively, fewer or more O-rings can be used or threads and thread grooves can be used on sleeve 24 and tube 12. Other methods of removeably attaching two cylinders can be used as well, as is known in the art.

Tapered force distributor 25 is preferably comprised of steel. Alternatively, tapered force distributor 25 can be comprised of any rigid material softer than the race of the bearing being installed. Additionally, all other embodiments of the force distributor can be made of these same materials.

Figure 3A:
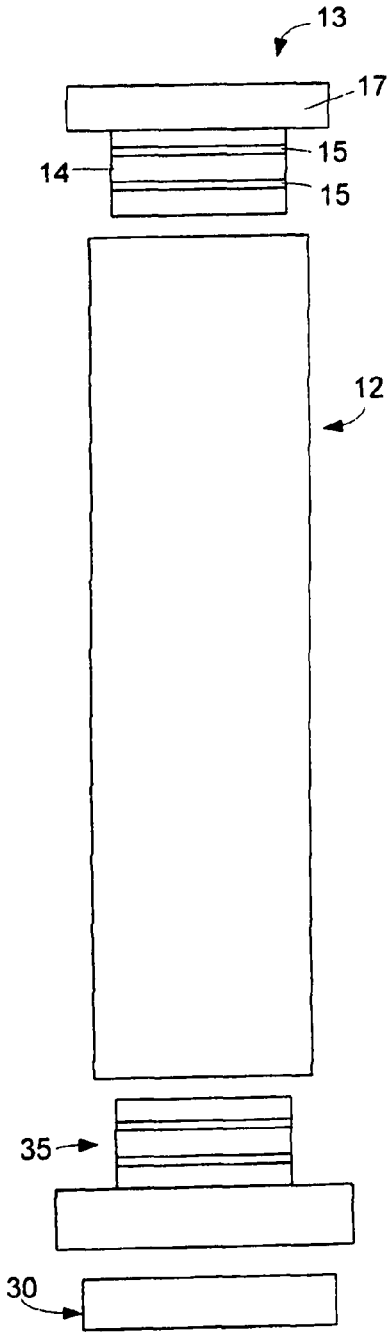
FIG. 3*a* illustrates the components of the second embodiment of the present invention.
Figure 3B:
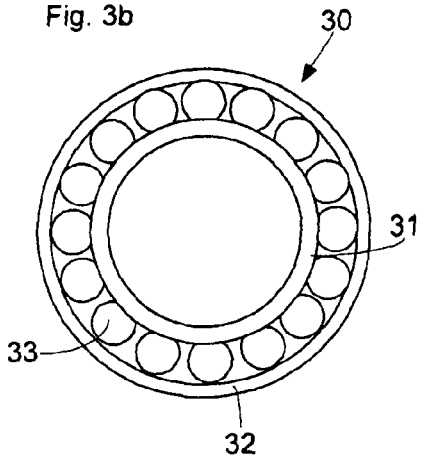
FIG. 3*b* is a top view of a ball bearing as used with the second embodiment of the present invention.
Figure 3C:
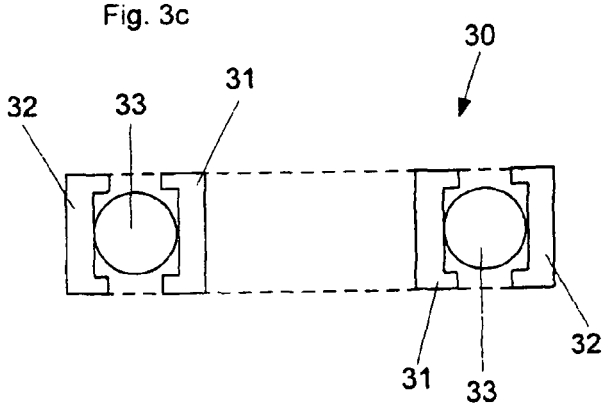
FIG. 3*c* is a cross-sectional view of a ball bearing as used with the second embodiment of the present invention.
Figure 3D:
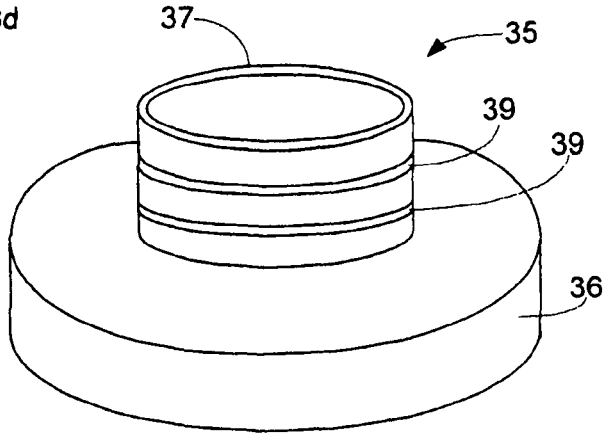
FIG. 3*d* is a perspective view of the force distributor of the second embodiment of the present invention.
Figure 3E:
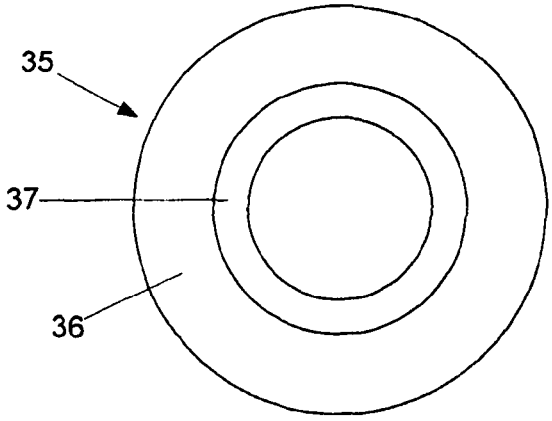
FIG. 3*e* is a top view of the force distributor of the second embodiment of the present invention.
Figure 3F:
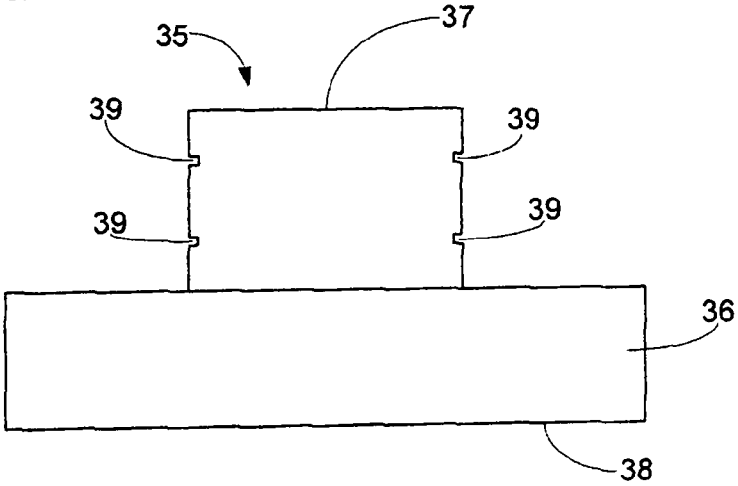
FIG. 3*f* is a cross-sectional view of the force distributor of the second embodiment of the present invention.

The force distributor in the second embodiment of universal installation tool 10 is a non-tapered force distributor 35, which can be used to install a non-tapered bearing such as a traditional ball bearing. Tapered force distributor 25 and non-tapered force distributor 35 are interchangeable. FIG. 3*a* illustrates the non-tapered force distributor 35 in use with a ball bearing 30. FIGS. 3*b*-3*c* illustrate ball bearing 30 in detail, and FIGS. 3*d*-3*f* illustrate non-tapered force distributor 35 in detail. In general, and as shown in FIGS. 3*b*-3*c*, a ball bearing has an inner race 31, an outer race 32 and spheres or balls 33. When positioning a ball bearing snugly on a shaft, it is particularly desirable to apply force equally and simultaneously to the inner and outer races. Accordingly, non-tapered force distributor 35 is designed so that it applies force equally and simultaneously to the inner and outer races.

As shown in the figures, non-tapered force distributor 35 is generally tubular in shape. Non-tapered force distributor 35 includes a sleeve 34 integrally connected with an annular flange 36. Flange 36 has a flat contact surface 38 that abuts ball bearing 30 when universal tool 10 is used.

Force distributor has an inner diameter large enough to be positioned over shaft 5 and preferably slightly larger than the inner diameter of the inner race of the bearing to be installed. In this preferred embodiment, the inner diameter of force distributor 35 is approximately 1¼ inches for all of its sections.

The outer diameter of force distributor 35 at the sleeve 34 is slightly narrower than the inner diameter of tube 12. In the preferred embodiment, the outer diameter of the flange is equal to or larger than the outer diameter of the outer race 32 of the bearing to be installed. In the preferred embodiment, the outer diameter of sleeve 34 is approximately 1⅝ inches and of flange 36 is approximately 3 inches.

The height of the various parts of force distributor 35 can vary depending on the bearing to be installed, as is known in the art. In the preferred embodiment, the height of sleeve 34 is approximately ¾ inches and of flange 36 is approximately ⅝ inches.

As with the preferred embodiment of the force distributor, around the outer surface of the sleeve 34 of this embodiment of force distributor 35 there are two annular grooves 39 for holding rubber O-rings. Sleeve 34 can be inserted in tube 12 such that the distal end of tube 12 abuts flange 36, and the O-rings ensure a snug and secure frictional fit yet still allow force distributor 35 to be detached and interchanged for other force distributors. Alternatively, fewer or more O-rings can be used or threads and thread grooves can be used on sleeve 34 and tube 12. Other methods of removeably attaching two cylinders can be used as well, as is known in the art.

Figure 4A:
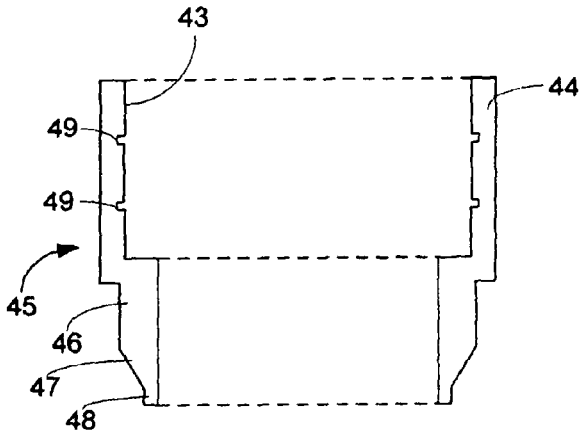
FIG. 4*a* is a cross-sectional view of an alternative embodiment of the force distributor of the first embodiment of the present invention.
Figure 4B:
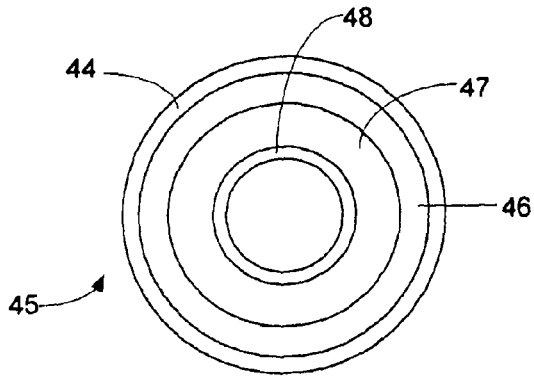
FIG. 4*b* is a bottom view of an alternative embodiment of the force distributor of the first embodiment of the present invention.
Figure 4C:
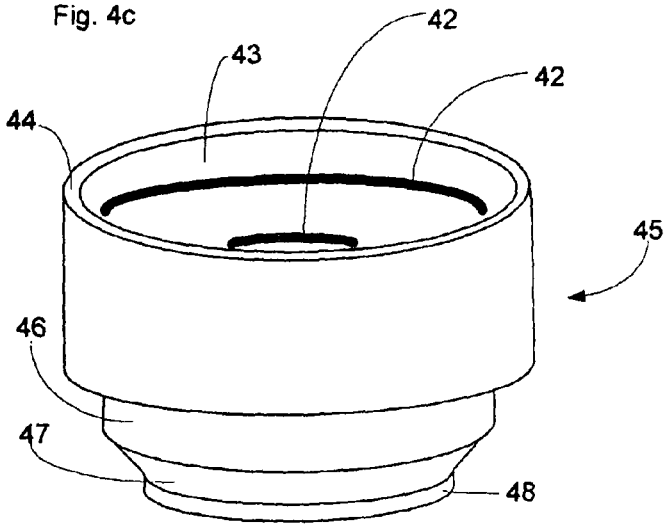
FIG. 4*c* is a perspective view of an alternative embodiment of the force distributor of the first embodiment of the present invention.

FIGS. 4*a*-4*c* illustrate another embodiment of a tapered force distributor 45. As with the preferred embodiment of the tapered force distributor, this embodiment of the tapered force distributor 45 also is generally tubular in shape and includes a sleeve 44 integrally connected with an annular flange 46. The flange integrally connects with an annular tapered or beveled section 47, which integrally connects with an annular contact region 48. Contact region 48 abuts the inner conical race 21 of tapered bearing 20 when universal tool 10 is in use.

In contrast to the preferred embodiment of tapered force distributor, for this alternative modified tapered force distributor 45, sleeve 44 has a larger inner diameter than the inner diameter of the flange 46, beveled section 47, and contact region 48. The inner diameter of sleeve 44 is slightly larger than the outer diameter of tube 12. The inner diameters of the other force distributor parts are large enough to be positioned over shaft 5 and preferably slightly larger than the inner diameter of the inner race of the bearing to be installed. Additionally the inner diameter of the flange 46, beveled section 47, and contact region 48 is preferably no larger than the inner diameter of tube 12.

This alternative embodiment includes annular grooves 49 along the inner surface 43 of sleeve 44 for accommodating O-rings 42. Tube 12 can be inserted into sleeve 44 such that the distal end of tube 12 abuts flange 46. The O-rings removeably secure section 44 around tube 12, ensuring a snug and secure fit yet still allowing force distributor 45 to be detached and interchanged for other force distributors. Alternatively, fewer or more O-rings can be used or threads and thread grooves can be used on sleeve 44 and tube 12. Other methods of removeably attaching two cylinders can be used as well, as is known in the art.

The outer diameter of force distributor 45 at the flange 46 is the same as or larger than the outer diameter of tube 12. Contact region 48 has an outer diameter smaller than flange 46. Preferably, the outer diameter of contact region 48 is slightly smaller than the outer diameter of the inner race of the tapered bearing to be installed. Beveled section 47 gradually decreases in outer diameter as it connects flange 26 and contact region 48, as shown in FIGS. 4*a*-4*c*.

The height of each section of force distributor 45 can vary depending on the bearing to be installed, as is known in the art. Any height that allows for adequate placement of the contact region 48 on the inner race of the tapered bearing to be installed is acceptable. Additionally, contact region 48 can be of negligible height and just the bottom edge or surface of beveled section 47.

As with a tapered force distributor, a non-tapered force distributor or any other force distributor can be modified so that the distal end of tube 12 is inserted into the sleeve of the force distributor and attached in a manner similar to modified tapered force distributor 45. While every embodiment is not shown exhaustively in figures, a person skilled in the art would be able to modify the sleeves of the interchangeable force distributors for attachment to tube 12 in substantially the same manner as modified force distributor 45. See FIG. 6 for an illustration of an externally mounted non-tapered force distributor 61 as used with a press-through design of universal tool 10.

Figure 5A:
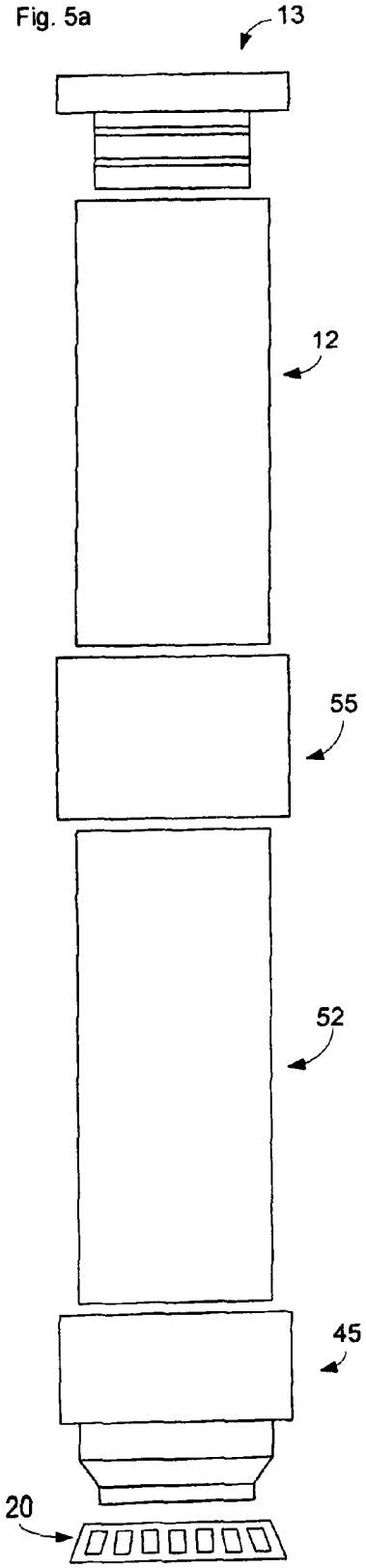
FIG. 5*a* illustrates the components of an alternative embodiment of the present invention using multiple tubes.
Figure 5B:
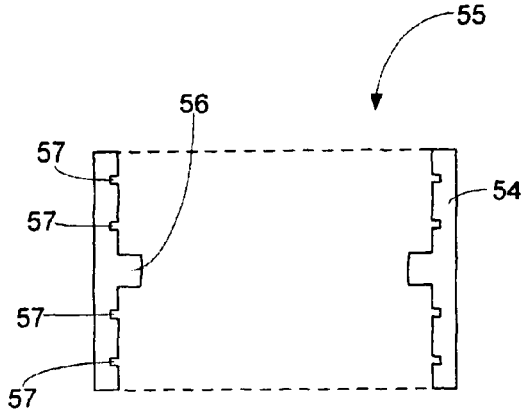
FIG. 5*b* is a cross-sectional view of the connector for the embodiment of the present invention using multiple tubes.
Figure 5C:
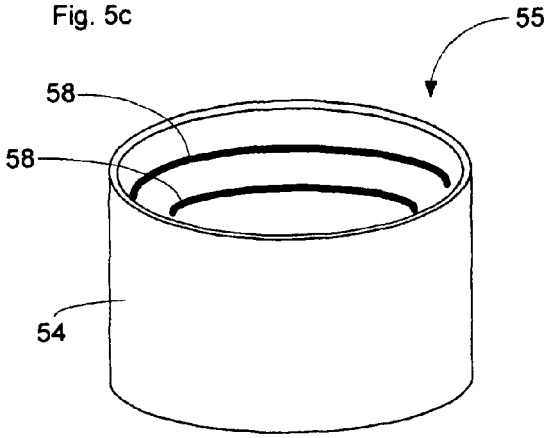
FIG. 5*c* is a perspective view of the connector for the embodiment of the present invention using multiple tubes.

FIGS. 5*a*-5*c* illustrate universal tool 10 with two tubes and a connector for use with longer shafts. A tubular connector 55 can be used to connect the distal end of one tube 12 with the proximal end of a second extender tube 52. Cap 13 removeably attaches to the proximal end of the first tube 12 and a force distributor 45 attaches to the distal end of the second extender tube 52. Connector 55 is a sleeve 54 integrally formed with an annular flange 56 that extends near the center of sleeve 54 radially inward.

The inner diameter of flange 56 is preferably equal to the inner diameter of tubes 12 and 52, although any diameter smaller than the inner diameters of tubes 12 and 52 but larger than shaft 5 will be adequate. The inner diameter of the rest of the sleeve is slightly larger than outer diameter of tubes 12 and 52. The outer diameter of sleeve 54 is preferably small enough to allow universal tool 10 to be used inside of a housing. In the preferred embodiment, the inner diameter of flange 56 is approximately 1⅝ inches and of the rest of sleeve 54 is approximately 2 inches. The outer diameter of sleeve 54 is approximately 2½ inches.

Along the inner surface of sleeve 54 above and below flange 56 are one ore more annular grooves 57 for housing one or more rubber O-rings 58. When the distal end of tube 12 and the proximal end of tube 52 are inserted in sleeve 54, the O-rings removeably and frictionally secure the tubes. Alternatively, threads and thread grooves or any other method of removeably attaching cylinders can be used, as is known in the art. The height of connector 55 depends on how many grooves or threads and thread grooves are necessary to adequately secure housings 12 and 52 to connector 55. In the preferred embodiment, there are four O-rings, and the height of connector 55 is approximately 1¾ inches. Flange 56 is located at the midpoint, and its height is approximately ¼ inches.

Multiple tubes can be linked together with connector 55 to accommodate any length of shaft 5. Connector 55 is preferably comprised of steel. Alternatively, connector 55 can be comprised of any rigid material softer than the race of the bearing being installed.

Figure 6:
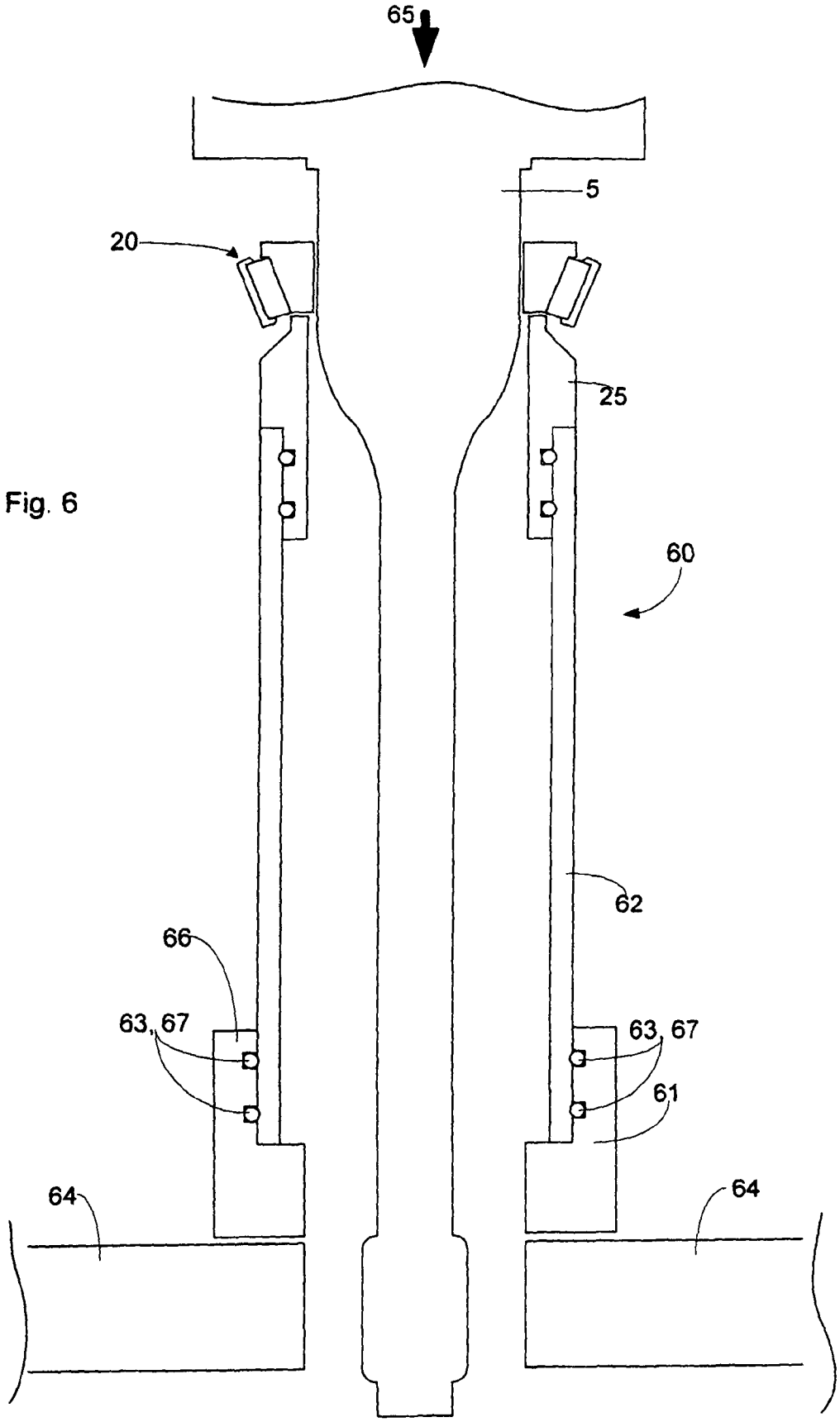
FIG. 6 is a cross-sectional view of the components of an alternative embodiment of the present invention that cooperates with a press machine.

FIG. 6 illustrates a press-through embodiment of the present invention where the universal tool 10 can be used with a machine press, such as a hydraulic press or pneumatic press. In order to cooperate with a hydraulic press, for example, the cap is a non-tapered force distributor 61 that attaches to tube 62 at its proximal end. In the preferred embodiment, non-tapered force distributor 61 attaches externally, or around tube 62, as shown in FIG. 6. Alternatively, non-tapered force distributor 61 can be identical to the non-tapered force distributor illustrated in FIGS. 3*a*-3*f*. An appropriate force distributor attaches to the distal end of tube 62 depending on the bearing being installed. FIG. 6 shows tapered force distributor 25 for installing tapered bearing 20 on shaft 5. The universal tool is then inverted, allowing non-tapered force distributor 61 to be a base that can support tube 62 on the hydraulic press table or base 64. The hydraulic press then allows for a continuous force 65 to be applied, as opposed to applying a staccato force with a hammer or other tool. It also allows for a bearing to be installed over a shaft that is longer than the tube.

Non-tapered force distributor 61 is annular and has an inner diameter and outer diameter as with the various embodiments of the force distributors. The inner diameter is large enough accommodate shaft 5. The outer diameter is any diameter sufficient or appropriate for supporting and securing inverted tool 10 on the hydraulic press. In the preferred embodiment, the inner diameter of non-tapered force distributor 61 is approximately 1½ inches and the outer diameter of non-tapered force distributor 61 is approximately 3 inches. The inner diameter of tube 62 is approximately 1⅝ inches and the outer diameter of tube 62 is approximately 2 inches. The height of tube 62 is approximately 2⅝ inches and the height of non-tapered force distributor 61 is approximately 1 inch.

Non-tapered force distributor 61 can attach to tube 62 with a sleeve 66. Non-tapered force distributor 61 can be attached with frictional O-rings 63 situated in annular grooves 67 in the sleeve 66, or it can be secured with threads and thread grooves to tube 61 either by inserting tube 62 into non-tapered force distributor 61 or vice versa. Alternatively, non-tapered force distributor 61 can be integrally formed with, or permanently attached to, tube 62. In the preferred embodiment, non-tapered force distributor 61 is removeably and frictionally attached to tube 61 with two O-rings.

Non-tapered force distributor 61 and tube 62 are again preferably comprised of steel. Alternatively, they can be comprised of any rigid material softer than the race of the bearing being installed.

While the universal tool has been described with reference to bearings, any type of annular member or device can be installed on a shaft with the universal tool present herein. For example, universal tool 10 is also useful for installing pulleys and pressure gears, as will be understood by those skilled in the art.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A universal tool for installing annular parts including tapered and non-tapered bearings on shafts, the tool comprising:

a. a hollow tube comprising a proximal end and a distal end;

b. a cap removeably attached to the tube near the proximal end of the tube, the cap having a top member and a stem extending down from the top member, wherein the top member has a diameter larger than a diameter of the hollow tube and abuts the proximal end of the hollow tube, the stem extending into the hollow tube;

c. one or more interchangeable force distributors, wherein one of the interchangeable force distributors is removeably attached to the tube near the distal end of the tube, wherein the one or more interchangeable force distributors have a sleeve that extends into the hollow tube and a flange attached to the sleeve wherein the flange member abuts against the distal end of the hollow tube;

wherein the flange applies pressure to an inner race for a tapper bearing and to both an inner and an outer race for a non-tapered bearing;

wherein the cap and the one or more interchangeable force distributors form a secure friction fit between the hollow tube and the cap and between the hollow tube and the one or more interchangeable force distributors.

2. A universal tool for installing tapered and non-tapered bearings on shafts, the tool comprising:

a. a hollow tube comprising a proximal end and a distal end;

b. a cap having a top member and a stem extending down from the top member, wherein the top member having a diameter larger than a diameter of the hollow tube and abuts the proximal end of the hollow tube such that a portion of the stem extends into the hollow tube, wherein the cap is removeably attached to the tube at the proximal end of the tube and wherein the cap is capable of cooperating with a machine press; and c. a first interchangeable force distributor comprising a sleeve, an annular flange that is integrally attached to the sleeve and extends radially outward from the sleeve; an annular beveled section integrally attached to the flange; and an annular contact region having a diameter smaller than the flange and integrally attached to the beveled section that applies pressure to an inner race of a bearing;

wherein the first interchangeable force distributor is removeably secured to the tube by inserting the sleeve of the first interchangeable force distributor into the distal end of the tube abuts the flange of the inserted force distributor; and wherein the entire universal tool can be inverted and used in cooperation with a hydraulic press.

* * * * *